United States Patent [19]

Bennett

[11] 4,454,830

[45] Jun. 19, 1984

[54] SEWING MACHINE PRESSER FOOT HAVING CHANGEABLE ZONE OF RECIPROCATION

[75] Inventor: George Bennett, Milford, N.H.

[73] Assignee: International Shoe Machine Corporation, Nashua, N.H.

[21] Appl. No.: 316,007

[22] Filed: Oct. 28, 1981

[51] Int. Cl.[3] ..... D05B 29/02

[52] U.S. Cl. ..... 112/239

[58] Field of Search ..... 112/237, 121.14, 236, 112/239, 78, 121, 235

[56] References Cited

U.S. PATENT DOCUMENTS

| | | | |
|---|---|---|---|
| 2,422,820 | 6/1947 | Best | 112/237 |
| 2,750,908 | 6/1956 | Odermann et al. | 112/235 |
| 3,473,497 | 10/1969 | Cash | 112/239 |
| 3,661,102 | 5/1972 | Tice | 112/239 X |
| 3,776,159 | 12/1973 | Angele | 112/235 |
| 3,779,184 | 12/1973 | Blanc | 112/239 X |
| 4,024,826 | 5/1977 | Knight et al. | 112/235 |
| 4,273,059 | 6/1981 | Kamal | 112/121.14 |
| 4,292,907 | 10/1981 | Gilbride et al. | 112/236 |

*Primary Examiner*—Werner H. Schroeder
*Assistant Examiner*—Andrew M. Falik

[57] ABSTRACT

A sewing machine having a needle and a presser foot that are reciprocated in synchronism and an arrangement for changing the zone of reciprocation of the presser foot during the reciprocations of the needle and the presser foot.

3 Claims, 3 Drawing Figures

SEWING MACHINE PRESSER FOOT HAVING CHANGEABLE ZONE OF RECIPROCATION

BACKGROUND OF THE INVENTION

Pfaff sewing machine mode 483-798/01, manufactured in the Federal Republic of Germany and distributed in the United States by Cohen Shoe Machinery Company, Inc. located at 35 Congress Street, Salem, Mass. 01970, is an example of a sewing machine that can form decorative stitches in a workpiece such as a shoe upper by reciprocating a needle and a presser foot in synchronism so that the needle penetrates the workpiece at spaced intervals and forms stitches in the workpiece and the presser foot engages the workpiece during its penetration by the needle to hold the workpiece stationary and rises upwardly of the workpiece to permit shifting of the workpiece relative to the needle between penetrations of the needle into the workpiece.

When the thickness of the workpiece varies, it has been found that a zone of reciprocation of the presser foot for a relatively thin workpiece portion that is satisfactory is unsatisfactory for a thicker workpiece portion. With the thinner workpiece portion, the presser foot in its lowermost position engages the workpiece top with sufficient pressure to prevent its shifting with a thicker workpiece portion and with the zone of reciprocation of the presser foot unchanged, it has been found that the presser foot penetrates the workpiece too deeply and either mars the workpiece, causes the resistance to penetration of the workpiece by the presser foot to damage the parts that effect the reciprocation of the presser foot, or adversely affects the timing of the motions of the needle and the presser foot to thereby adversely affect the quality of the stitches formed in the workpiece.

SUMMARY OF THE INVENTION

While prior art devices, such as are shown in U.S. Pat. Nos. 1,826,610 and 2,183,185, show presser foots that are stationary during the sewing operation and which can be adjusted to change the distance between the presser foot and the support on which the workpieces are located, such arrangements are not satisfactory for sewing machines of this invention wherein the reciprocating presser feet are disengaged from the workpiece while the workpiece is shifted between successful penetrations of the workpiece by the needle. In order to overcome this deficiency, the present invention provides an arrangement for changing the zone of reciprocation of the presser foot during the reciprocations of the needle and the presser foot in order to accommodate the presser foot to a thicker workpiece portion during the operation of the sewing machine.

DESCRIPTION OF THE PREFERRED EMBODIMENT

Figure 1:
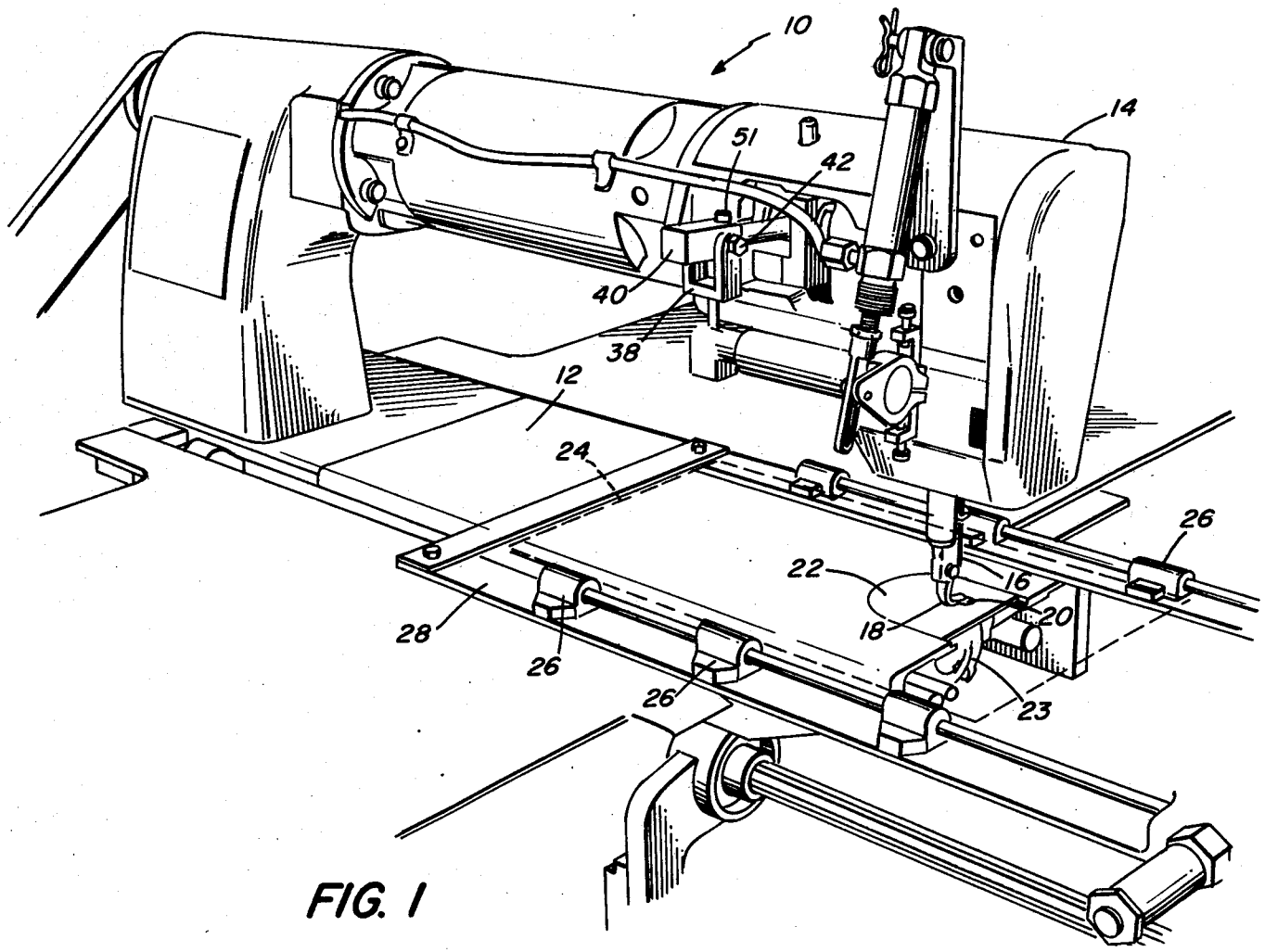
FIG. 1 is an isometric view of the sewing machine of this invention.

FIG. 1 shows the sewing machine 10 which has been modified in accordance with this invention. The sewing machine 10 is anchored to a support 12 and has a head 14 at its front end in which a needle 16 and a presser foot 18 are reciprocably mounted. A conventional drive mechanism within the head 14 is actuable to vertically reciprocate the needle 16 into and out of an opening 20 in a throat plate 22 with the needle cooperating with a bobbin assembly 23 located below the throat plate 22 to form stitches on a workpiece 24, shown in phantom in FIG. 1, that is held between clamps 26 of a frame 28. By known means, such as is shown in U.S. Pat. Nos. 3,208,415 and 3,385,244, the frame 28 is caused to intermittently shift in X and Y directions that respectively extend transversely and longitudinally of the sewing machine so that the reciprocating needle 16 can penetrate the workpiece 24 and rise above the workpiece while the workpiece is stationary and again penetrate the workpiece after the workpiece has shifted to thereby form decorative stitches in a predetermined pattern in the workpiece which is in the form of a shoe upper.

The shifting of the frame 28 along the X and Y axes is caused, similarly to the manner shown in U.S. Pat. No. 3,385,244, by a tape which emits signals to a computer that effects the shifting of the frame 28.

The presser foot 18 is reciprocated, in the manner described below, to engage the workpiece 24, at the bottom of its zone of movement, to hold the workpiece stationary against the throat plate 22 while the needle 16 is in engagement with the workpiece and to rise above and release the workpiece while the workpiece is being shifted by the frame 28 along the X and Y axes.

Figure 3:
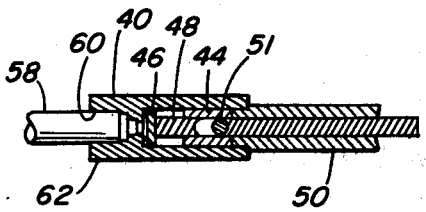
FIG. 3 is a section taken along the line 3—3 of FIG. 2.
Figure 2:
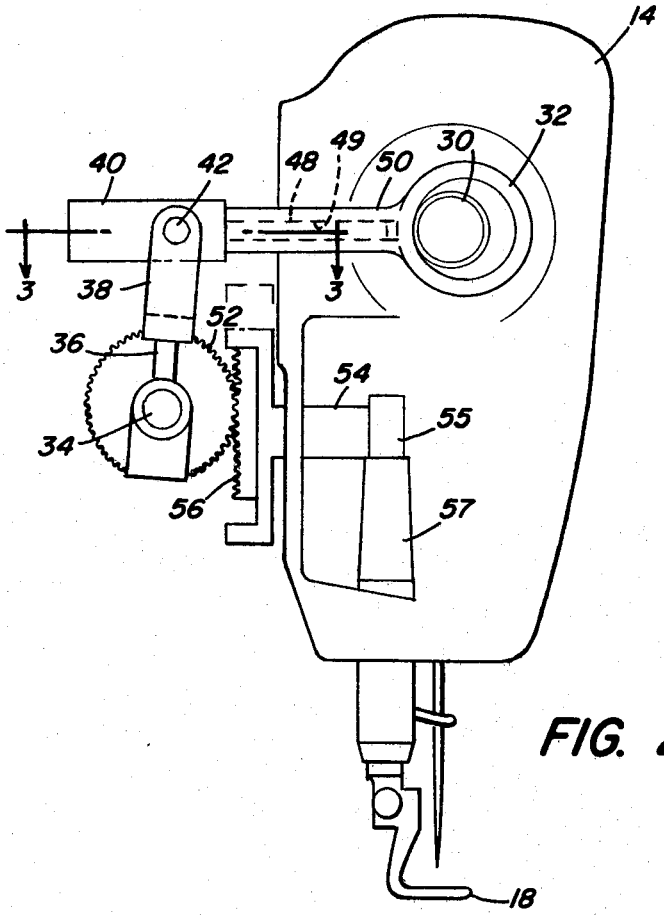
FIG. 2 is an elevation of the head of the sewing machine showing the needle, the presser foot, and the drive for reciprocating the presser foot.

Referring to FIGS. 2 and 3, the presser foot 18 is reciprocably mounted for heightwise movement in the head 14. A rotating shaft 30 operates an eccentric 32 mounted thereon. A pin 34, pivoted to the head 14, has a rod 36 extending upwardly therefrom. The rod 36, which is fixed to the pin 34 to move in unison therewith, has a clevis 38 that extends about a tube 40. The clevis 38 is pinned by a pin 42 to the tube 40. A piston 46 is slidably mounted in the tube 40. The piston rod 48 of the piston 46 extends rightwardly (FIG. 3) of the piston 46 through the tube 40 and an interior passage 49 of a rod 50. A sleeve 44 encompasses and is slidable on the piston rod 48, the sleeve 44 being affixed to the tube 40 by a pin 51. The rod 50 extends between and is connected to the eccentric 32 and the tube 40. A pinion segment 52 is so connected to the pin 34 as to move in unison therewith. A holder 54 is affixed to the top 55 of the presser foot 18 to reciprocate in unison therewith with top 55 being slidable in a bushing 57. A rack 56, that is in mesh with the pinion segment 52, is secured to the holder 54 to reciprocate in unison therewith. A hose 58, which is connected to a source of pressurized air, not shown, is mounted to the left end (FIG. 3) of the tube 40. The hose 58 is in communication with the piston 46 by means of a passage 60 in the tube 40.

In the operation of the machine, with no pressurized air entering the hose 58, a spring, not shown, in the head 14 yieldably urges the holder 54 and the rack 56 downwardly to thereby swing the clevis 38 clockwise (FIG. 2) about the axis of the pin 34 and thus urge the head 62 of the tube 40 that encompasses the passage 60 yieldably into engagement with the piston 46 with the right end (FIG. 3) of the piston rod 48 bearing against the right end of the passage 49. This has the effect of causing the rotation of the shaft 30 to vertically reciprocate the presser foot 18 with the lower end of its zone of reciprocation being such as to engage and press the workpiece 24 against the throat plate 22 and hold the workpiece stationary while the needle 16 is penetrating the workpiece 24. This operation of the presser foot 18 takes place when a relatively thin workpiece portion is being sewn. The raising of the presser foot 18 out of engagement with the workpiece 24 while the needle 16 is disengaged from the workpiece enables the workpiece to be shifted between needle penetrations of the workpiece along the X and Y axes as described above without any resistance to such shifting by the presser foot 18.

When a relatively thick portion of the workpiece is being sewn, it is desirable to raise the zone of reciprocation of the presser foot 18 for the reasons stated above in the Background of the Invention. This is accomplished by causing pressurized air to pass through the hose 58 and the passage 60 against the piston 46 to thereby cause the tube 40 to move leftwardly (FIG. 3) along the piston 46 and also cause the sleeve 44 to move leftwardly until these leftward movements are terminated by the engagement of the sleeve 44 with the right end of the piston 46. These leftward movements cause the clevis 38 to swing counterclockwise (FIG. 2) about the axis of the pin 34 to thereby, by means of the pinion segment 52 and the rack 56, raise the presser foot 18. As a result, the zone of oscillation of the pin 34 is shifted counterclockwise (FIG. 2) and the zone of reciprocation of the presser foot 18 is raised while the amplitude of this oscillation and this reciprocation is substantially unchanged.

The admission of pressurized air to the hose 58 and the venting of pressurized air from the hose 58 is caused by signals from the tape to the computer that effects the shifting of the table 28 along the X and Y axes.

There follows a recapitulation of those portions of the description of the machine and its mode of operation that are germane to this invention.

The sewing machine comprises: the head 14; the needle 16 reciprocably mounted in the head 14 for penetrating movement into and out of the workpiece 24 supported on the throat plate 22 beneath the needle; means incorporated in the head 14 and not shown for affecting the needle reciprocation; means, not shown herein but of the type disclosed in U.S. Pat. No. 3,385,244, for shifting the workpiece 24 while the needle 16 is disengaged from the workpiece to thereby enable successive penetrations of the needle into the workpiece to form stitches in the workpiece; the presser foot 18 reciprocably mounted in the head 14 adjacent the needle 16; and means shown in FIG. 2 for reciprocating the presser foot in sychronism with the reciprocation of the needle so that the presser foot presses against the workpiece 24 and prevents shifting of the workpiece during the penetration of the workpiece by the needle.

The machine described in the preceding paragraph is improved in accordance with this invention by comprising changing means, shown in FIGS. 2 and 3, effective to change the zone of reciprocation of the presser foot 18 during the reciprocations of the needle 16 and the presser foot 18 to accommodate the presser foot to changes in the thickness of the workpiece 24.

The means for reciprocating the presser foot and the changing means comprise: the pin 34 mounted for oscillation; a connection formed by the pinion segment 52 and the rack 56 effective to reciprocate the presser foot 18 pursuant to oscillation of the pin; means for effecting oscillation of the pin 34 to thereby effect reciprocation of the presser foot 18; and means for changing the zone of oscillation of the pin 34 to thereby effect the change in the zone of reciprocation of the presser foot 18.

The means for oscillating the pin 34 and the means for changing the zone of oscillation of the pin 34 comprise: the tube 40; the head 62 in the outer end (the left end in FIG. 3) of the tube 40; the piston 46, bearing against the inner end (the right end in FIG. 3) of the head 62, having the inwardly (rightwardly in FIGS. 2 and 3) extending piston rod 48; the passage 60 in the head 62 connected to a source of pressurized air; drive means, in the form of the shaft 30, the eccentric 32 and the rod 50, for reciprocating the piston rod 48 and thus reciprocating the tube 40; and a second connection, formed by the pin 42, the clevis 38 and the rod 36, between the tube 40 and the pin 34 so constructed as to oscillate the pin 34 pursuant to reciprocation of the tube 40; the admission of pressurized air through the head passage 60 moving the inner end (the right end in FIG. 3) of the head 62 outwardly (leftwardly in FIG. 3) and away from the piston 46 and thus moving the tube 40 outwardly (leftwardly in FIG. 3) with respect to the piston rod 48 to thereby, through the second connection, change the zone of oscillation of the pin 34.

I claim:

1. A sewing machine comprising: a sewing machine head; a needle reciprocably mounted in the head for penetrating movement into and out of a workpiece supported on a throat plate beneath the needle; means for effecting the needle reciprocation; means for shifting the workpiece while the needle is disengaged from the workpiece to thereby enable successive penetrations of the needle into the workpiece to form stitches in the workpiece; a presser foot reciprocably mounted in the head adjacent to the needle; means for reciprocating the presser foot in synchronism with reciprocation of the needle so that the presser foot presses against the workpiece and prevents shifting of the workpiece during the penetrations of the workpiece by the needle; characterized in that the machine comprises air-actuated changing means effective to change the zone of reciprocation of the presser foot during the reciprocations of the needle and the presser foot to accommodate the presser foot to changes in the thickness of the workpiece, the means for reciprocating the presser foot and the changing means comprising a pin mounted for oscillation, a connection between the presser foot and the pin effective to reciprocate the presser foot pursuant to oscillation of the pin, means for effecting oscillation of the pin to thereby effect reciprocation of the presser foot, and means for changing the zone of oscillation of the pin to thereby effect said change in the zone of reciprocation of the presser foot.

2. The machine according to claim 1 characterized in that the means for oscillating the pin and the means for changing the zone of oscillation of the pin comprise: a tube; a head at the outer end of the tube; a piston, bearing against the inner end of the head, having an inwardly extending piston rod; a passage in the head connected to a source of pressurized air; drive means for reciprocating the piston rod and thus reciprocating the tube; and a second connection between the tube and the pin so constructed as to oscillate the pin pursuant to reciprocation of the tube; the admission of pressurized air through the head passage moving the inner end of the head outwardly and away from the piston and thus moving the tube outwardly with respect to piston rod to thereby, through the second connection, change the zone of oscillation of the pin.

3. A sewing machine according to claim 1 in which the air-actuated changing means comprises a rack and pinion that serve to change to zone of reciprocation, automatically, by an air-actuated mechanism, while the needle is disengaged from the workpiece.

* * * * *